US007007535B2

(12) United States Patent
McClung

(10) Patent No.: US 7,007,535 B2
(45) Date of Patent: Mar. 7, 2006

(54) METHOD AND APPARATUS FOR ALIGNING COMPONENTS OF A PRESS

(75) Inventor: James A. McClung, N. Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 280 days.

(21) Appl. No.: 10/686,352

(22) Filed: Oct. 14, 2003

(65) Prior Publication Data

US 2005/0076491 A1 Apr. 14, 2005

(51) Int. Cl.
*B21D 22/21* (2006.01)

(52) U.S. Cl. ..... 72/351; 72/336; 72/347; 72/348; 72/349; 72/350; 72/351; 29/464; 29/465; 29/466; 29/467; 29/468

(58) Field of Classification Search ..... 29/465, 29/464–468; 72/329, 336, 347–351, 361, 72/379.4, 394, 399, 404, 405.1, 405.01, 405.06, 72/416

See application file for complete search history.

(56) References Cited

U.S. PATENT DOCUMENTS 3,352,141 A 11/1967 Boshold
3,703,094 A 11/1972 Cree, Jr.
4,412,469 A 11/1983 Hirata et al.
5,060,501 A 10/1991 Heath
5,626,048 A 5/1997 McClung
5,628,224 A 5/1997 McClung et al.
5,890,402 A 4/1999 Nedbal
5,970,775 A 10/1999 McClung
6,032,505 A * 3/2000 Stodd ..... 72/336
6,212,934 B1 4/2001 Tseng
6,539,767 B1 * 4/2003 McClung ..... 72/336

* cited by examiner

*Primary Examiner*—Derris H. Banks
*Assistant Examiner*—Hung C. Le
(74) *Attorney, Agent, or Firm*—Eric A. Lerner; David P. Maivald; Eckert Seamans Cherin & Mellott, LLC

(57) ABSTRACT

A method and apparatus for aligning opposed telescopically engageable cut ring and blank and draw die when mounted in a can body forming press to form non-round disc-shaped blanks which are subsequently formed into container bodies. A pair of opposed precision formed notches are formed in the peripheries of the spaced press components and a precision formed key is inserted into the notches. The key is then slidably removed from the notches. The notches are precisely located with respect to each other and to major and minor axes of the press components so that said major and minor axes align with each other when the key is seated in the notches.

20 Claims, 4 Drawing Sheets

METHOD AND APPARATUS FOR ALIGNING COMPONENTS OF A PRESS

BACKGROUND OF THE INVENTION

1. Technical Field

The invention relates to forming non-round disc-shaped blanks from sheet material in a forming press for subsequent formation into round container components. More particularly, the invention relates to a method and apparatus for aligning telescopically engageable press components which form the non-round blanks, namely opposed cut ring and opposed blank and draw die. Even more particularly, the invention relates to the accurate aligning of the non-round components without removing the same from the press by engagement of an accurately formed alignment key with the spaced components.

2. Background Information

In the container forming art, a sheet of material, such as light-weight aluminum or steel, is fed into a press which forms a plurality of round or non-round disc-shaped blanks which are subsequently drawn into container components, such as the body and/or end shell therefor. It is known that for certain applications when forming can bodies, that a non-round disc-shaped blank is preferred for subsequent formation into a round can body, rather than a round disc-shaped blank since it provides better metal flow and efficiency and avoids wrinkling.

These round and non-round disc-shaped blanks are usually formed in a reciprocating press by telescopically moving an annular die cut ring about the outer cut surface of a blank and draw die in a downward press movement which shear the blank disc from the sheet material being moved therebetween. The alignment of the cut ring and blank and draw die is not a great problem where a round disc-shaped blank is produced. However, the proper alignment of the major and minor axes of the cut ring with respect to those of the blank and draw die is critical when producing a non-round disc-shaped blank due to the extremely close tolerances, generally 0.001 inches, between the shearing surfaces for forming the non-round disc blank. Thus, the alignment of these two components is critical when the cut ring telescopically moves beyond the blank and draw die, which is usually fixed on the base of the press, during a downstroke of the press component, to form a non-round blank.

Heretofore, this precision alignment of the cut ring, with respect to the blank and draw die, is performed at a site remote from the press location and is incorporated into the die sets which are subsequently shipped to the press location and installed therein.

However, at various times during operation of the press, such as when a malfunction occurs, the components may become out of alignment requiring reshipment of the entire die set back to the tool and die supplier for subsequent alignment of the cut ring with the blank and draw die.

Also, it is desirable in certain applications to be able to change the cut ring and blank and draw die in an existing press from producing a round disc-shaped blank to a non-round disc-shaped blank, which heretofore could require reshipment of the die set back to the supplier or require elaborate setup and alignment devices and means to accomplish this critical alignment.

Therefore, the need exists for an improved method and apparatus which enables a cut ring and a blank and draw die which produces non-round disc-shaped blanks, to be properly aligned in an existing press after a malfunction, jamming, or similar event occurs in the press, or when replacing a cut ring and blank and draw die used for producing round disc-shaped blanks to producing non-round blanks, avoiding shipment of the die set back to the supplier.

BRIEF SUMMARY OF THE INVENTION

One aspect of the invention includes providing a pair of precision-shaped openings in telescopically engageable cut ring and blank and draw die, which when accurately axially aligned with the axis of the press, insures that the major and minor axes thereof are accurately aligned to enable the cut ring and blank and draw die to form non-round blank-shaped discs for subsequent forming into container components Another feature of the invention is to provide an alignment key which is slidably inserted into notches formed in the peripheries of the cut ring and blank and draw die which enables these press components to be easily adjusted into precise alignment, afterwhich securement bolts are tightened to accurately position the components in axial alignment in the press for subsequent forming of the non-round disc-shaped blanks.

Still another aspect of the invention is to form the alignment key out of a single piece of tool steel having a parallelopiped-shaped main body, with a pair of outwardly extending stabilizing legs which are adapted to rest upon the periphery of the blank and draw die for slidably inserting the key into the precision formed notches of the spaced cut ring and blank and draw die.

A further feature of the invention is to form the alignment key with a right angled notch in one corner thereof to compensate for the difference in diameters between the cut ring and blank and draw die to facilitate the insertion of the alignment key therebetween and into the alignment notches.

A still further feature of the invention is to enable an existing press to be retrofitted easily at the press site for changing from press components which heretofore produced round disc-shaped blanks with press components for forming non-round disc-shaped blanks, without requiring elaborate setup and alignment procedures heretofore required.

These features are obtained by the method and apparatus of the present invention as set forth below.

BRIEF DESCRIPTION OF THE DRAWINGS

A preferred embodiment of the invention, illustrative of the best mode in which applicant contemplates applying the principles, is set forth in the following description and is shown in the drawings and is particularly and distinctly pointed out and set forth in the appended claims.

Similar numerals refer to similar parts throughout the drawings.

DETAILED DESCRIPTION OF THE INVENTION

Figure 1:
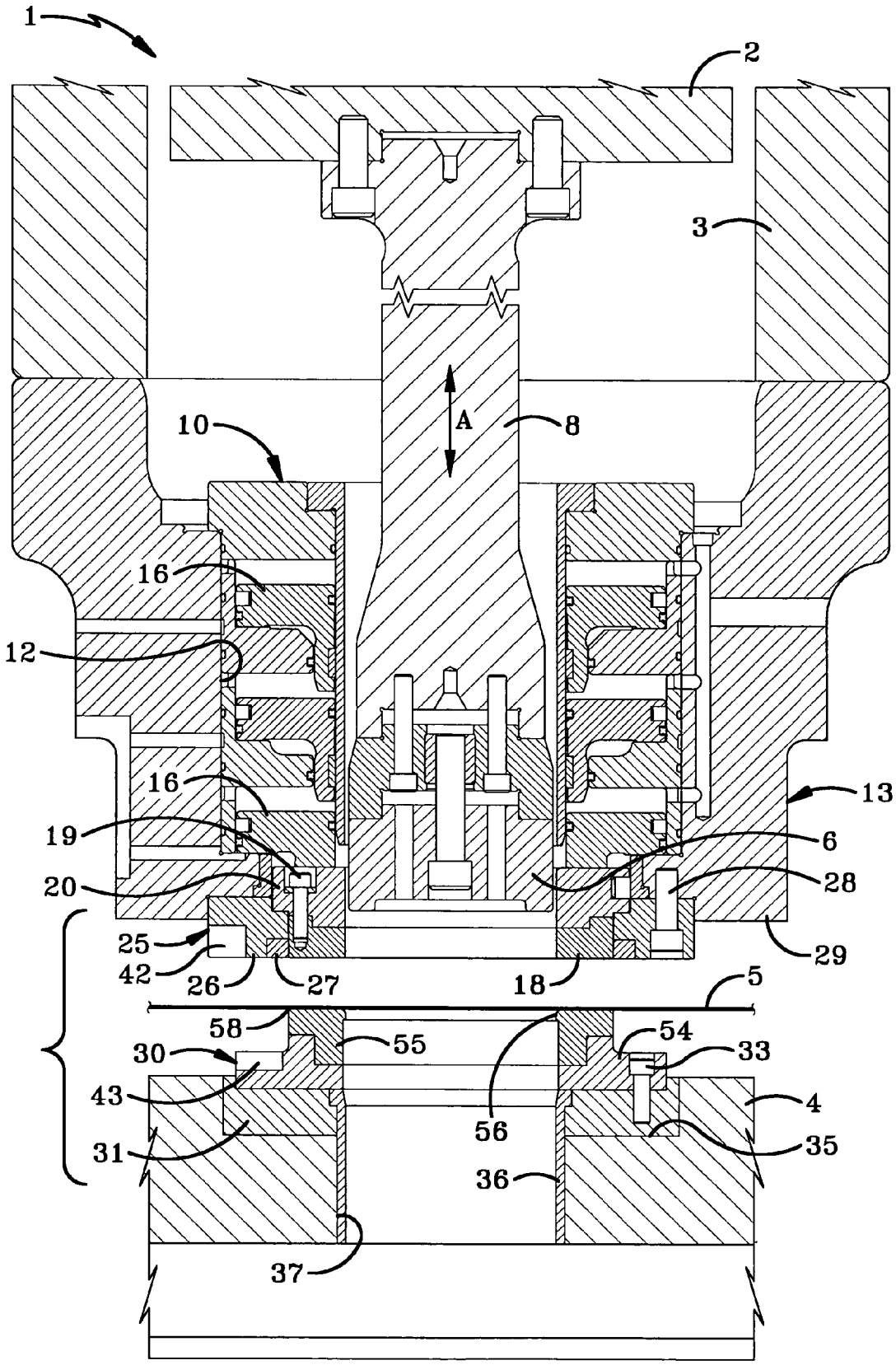
FIG. 1 is a fragmentary sectional view of a type of press for carrying out the method steps of the present invention having the improved alignment apparatus incorporated therein.

FIG. 1 illustrates one type of reciprocating press for carrying out the improved method of the present invention and which will utilize the apparatus of the present invention. Press 1 is illustrated as being a double action press and is of the type shown in U.S. Pat. Nos. 5,626,048; 5,628,224; and 5,970,775. However, other types of reciprocating presses can be utilized without affecting the concept of the invention.

Press 1 includes an inner ram 2 and an outer ram 3 movable toward and away from a generally fixed base 4 for forming disc-shaped blanks from sheet material 5. Inner ram 2 includes an inner die punch or draw horn 6 connected to a punch riser 8. Punch riser 8 will move draw horn 6 in a reciprocal vertical axial direction upon movement of inner ram 2 as shown by arrow A. A plurality of annular cylinders indicated generally at 10, are mounted in a vertical stacked relationship within an annular bore 12 of an outer ram housing 13. Pistons 16 move in unison within cylinders 10 upon actuation of outer ram 3.

An annular draw pad 18 is secured by bolts 19 to an annular draw pad mounting ring 20, which is operatively engageable with the lowermost piston 16. An annular cut ring indicated generally at 25, is generally a two-piece member having an outer clamp ring 26 in which is press-fitted a carbide cut member 27 having a non-round edge 27A. Cut ring 26 is mounted by a plurality of bolts 28 to the lower end 29 of outer ram housing 13 (FIG. 1). Base 4, which is indicated as being a fixed base, could be fluidly supported if desired in order to reduce the forces exerted thereon and to compensate for thermal expansion without affecting the concept of the invention.

An annular blank and draw die indicated generally at 30, is secured to a mounting ring 31 by a plurality of spaced bolts 33 (FIG. 1). Ring 31 is located within an annular recess 35 formed in base 4 and may also secure a cup drop sleeve 36 within a cylindrical opening 37 formed in base 4. It is readily understood that some features of the above described press may vary without effecting the concept of the invention.

Figure 2:
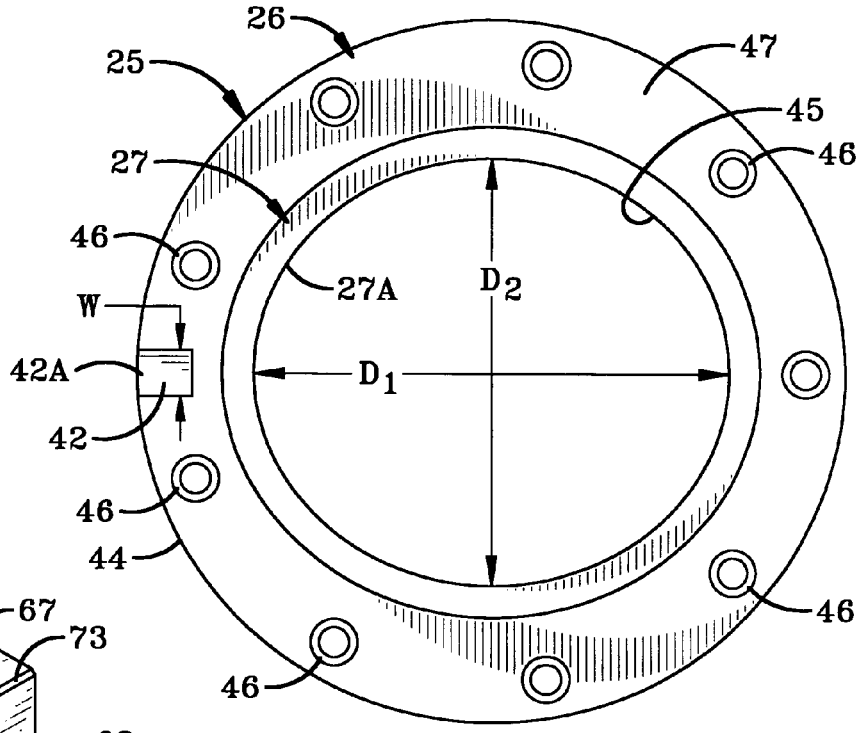
FIG. 2 is a bottom plan view of the cut ring component of the press of FIG. 1.
Figure 3:
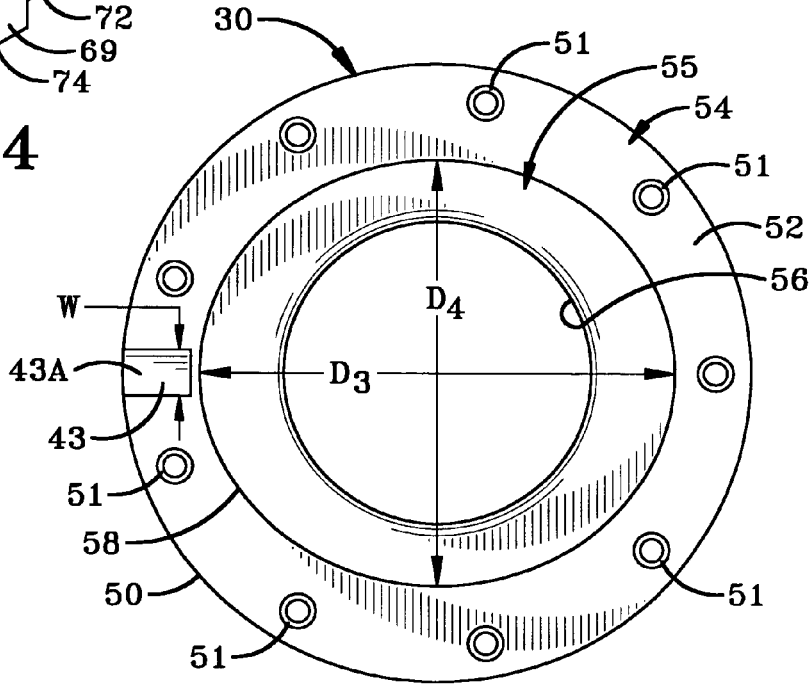
FIG. 3 is a top plan view of the blank and draw die component of the press of FIG. 1.

In accordance with the invention, cut ring 25 and blank and draw die 30 are formed with precision formed openings or notches 42 and 43, respectively (FIGS. 2 and 3). Cut ring 25 has a circular outer peripheral edge 44 and is formed with a non-round shaped opening 45 having a major axis D1 and a minor axis D2. A plurality of countersink holes 46 are formed in a flat annular portion 47 of clamp ring 26, each of which receives a securement bolt 28 therein. Blank and draw die 30 also is formed with an outer circular peripheral edge 50, which defines a flat periphery portion 52, formed with a plurality of circumferentially spaced countersink holes 51 in which bolts 33 are mounted. Blank and draw die 30 includes an annular base 54 (FIGS. 1 and 5), in which is secured by a press-fit or other attachment means, an annular carbide die 55 which has an inner draw radius 56 for forming a circular cup-shaped member upon passage of draw horn 6 therethrough. Die 55 further includes an outer non-round cut edge 58 which telescopically mates with non-round cut edge 27A of cut ring 25 for forming the non-round disc-shaped blanks. Cut edge 58 is defined by major axis D3 and minor axis D4 as shown in FIG. 3, which are precisely formed to be approximately 0.001 inches less than the corresponding major and minor axii D1 and D2 of cut ring edge 27A. It is the movement of cut edge 27A past cut edge 58 (FIG. 5), when outer ram moves downwardly in the direction of arrow B, which severs the non-round disc-shaped blank from strip material 5. This operation is standard in the container body forming art, and thus is not described in greater detail.

Openings 42 and 43 are formed in peripheral portions 47 and 52 of members 25 and 30 respectively, and preferably have a rectangular-shaped configuration and extend inwardly from the peripheral edges 44 and 50 thereof so as to slidably receive an alignment key indicated generally at 60, therein. In accordance with the invention, key 60 aligns the major and minor axes of annular members 25 and 30 with respect to each other, in order to provide for the accurate engagement thereof for severing the non-round disc-shaped blanks from strip material 5. However, if desired, openings 42 and 43 could be formed completely within peripheries 47 and 52 and have other configurations than rectangular without affecting the concept of the invention. However, the preferred configuration is rectangular, as shown in the drawings, providing a notch configuration having open ends 42A and 43A, respectively, enabling key 60 to be slidably inserted therein as discussed further below.

Openings 42 and 43 are accurately positioned with respect to their major and minor axes and to each other so that when in spaced vertical axial alignment in the press, the respective axes align with each other. In the preferred embodiment, openings 42 and 43 may be aligned with the major axes. However, this alignment can be changed without affecting the invention, i.e. they could align with the minor axes or be offset equally therefrom, so long as the two openings are located the same with respect to the major and minor axes.

Key 60 (FIG. 4) preferably is formed as a one-piece member of tool steel and has a generally parallelopiped-shaped main body 61, with a right angle cutout 62 being formed in one corner thereof. A pair of stabilizing legs 64 extend outwardly from opposed side walls 65. Key 60 further includes top and bottom surfaces 67 and 68, and front and rear surfaces 69 and 70, respectively. The top and bottom forward edges 72 of stabilizing legs 64 preferably are formed with tapered edges, as are corners 73 and 74 of cutout 62 to facilitate the insertion of key 60 within openings 42 and 43 and/or eliminate sharp corners.

Figure 5:
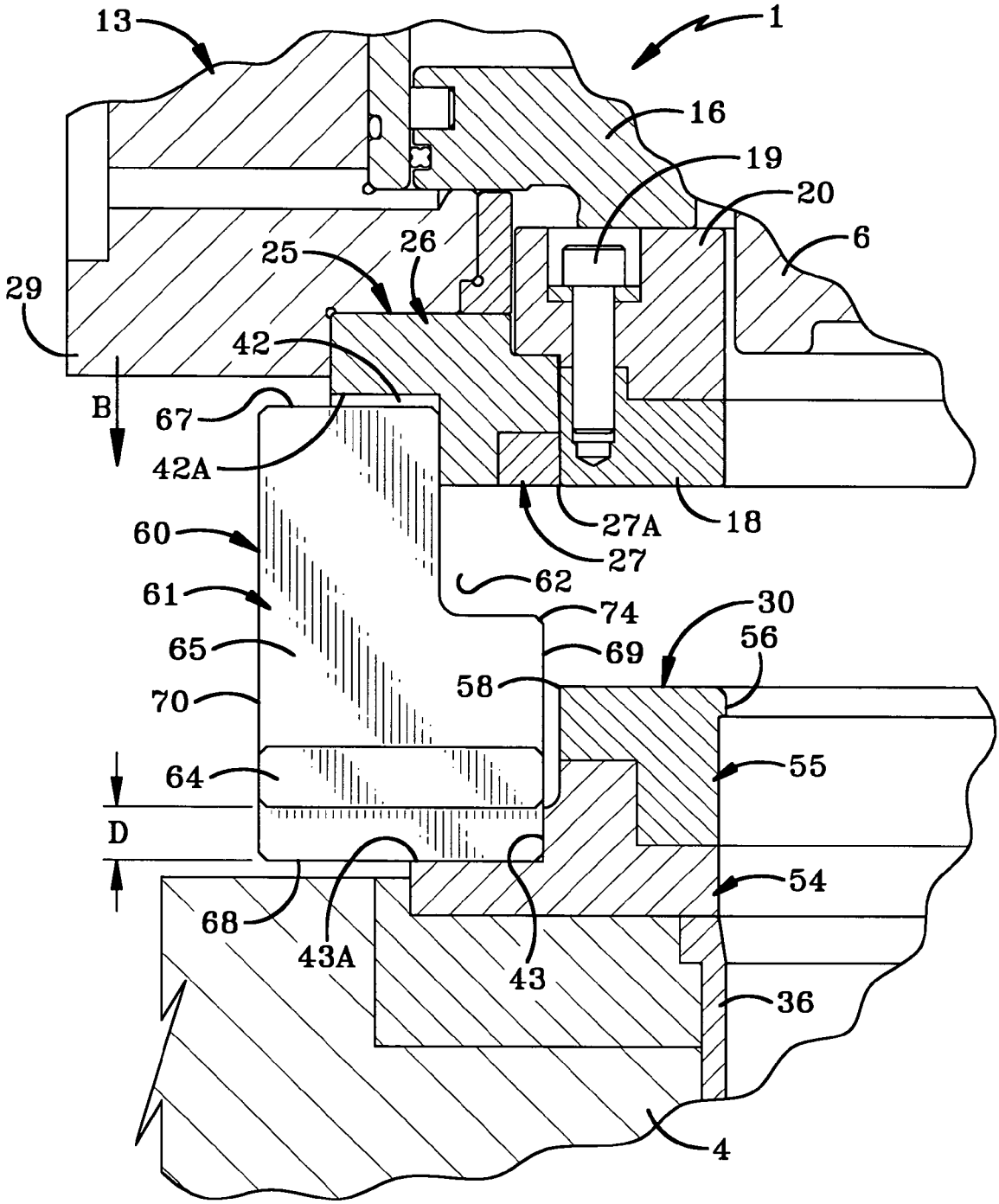
FIG. 5 is an enlarged fragmentary elevational sectional view, showing the alignment key being engaged in the precision formed notches of the cut ring and blank and draw die.

In accordance with another feature of the invention, the thickness of key 60, which is the distance between side walls 65, especially in the lower portion thereof below stabilizing leg 64 and the upper portion, is precision formed to provide a very tight sliding-fit engagement, with the precision formed widths W of openings 42 and 43. Preferably, the widths of each of the openings are the same just to facilitate the formation of key 60, but could have different dimensions so long as the widths thereof match the thickness of the upper and lower portions of key 60. Stabilizing legs 64 are formed above bottom surface 68 a distance D (FIG. 5) which is approximately equal to the depth of opening 43 to facilitate the manner of using alignment key 60 and properly aligning press components 25 and 30 as best shown in FIGS. 5–7.

Initially both members 25 and 30 are mounted in position on the press by their respective attachment bolts 28 and 33, with openings 42 and 43 being generally axially aligned with each other, that is, one is spaced above the other along the vertical or longitudinal axis of the press. Since openings 42 and 43 are accurately positioned with respect to the non-round blank forming edges 27A and 58, such as being in alignment with the major axes D1 and D3 as shown in FIGS. 2 and 3, this initial alignment will insure that the major and minor axis of the two members are generally in alignment with each other. Next, one of the members, preferably upper cut ring 25, is secured in position by tightening of bolts 28. Next, key 60 is slidably inserted in the generally aligned and spaced openings 42 and 43, as shown in FIGS. 5 and 6, and blank and draw die 30, which is loosely mounted in its position by bolts 33, is slightly rotated manually until key 60 firmly seats within the spaced openings. Due to the very close tolerances of 0.00 1 inches between key 60 and the walls forming openings 42 and 43, this will insure that the same close tolerances is provided between cut edges 27A and 58 when members 25 and 30 are telescopically engaged. After key 60 has been firmly seated within the openings by slight rotation of member 30, bolts 33 are then securely tightened which will maintain members 25 and 30 in correct axial alignment with each other for subsequent forming of the non-round blank discs.

Due to the mounting of members 25 and 30 with usual machine bolts which have a manufacturing tolerance of 1/32 inches, this would not provide the extreme accurate alignment required of the major and minor axes if members 25 and 30 were bolted in position without the use of key 60. Even though these differences are relatively slight, the 1/32 inch manufacturing tolerances in the bolts would not provide for the required close tolerance of 0.001 inch between the mating cut edges of members 25 and 30. After bolts 33 are tightened, key 60 is easily slidably removed from between the spaced members 25 and 30 in an outward direction perpendicular to the vertical axis of the press.

Figure 4:
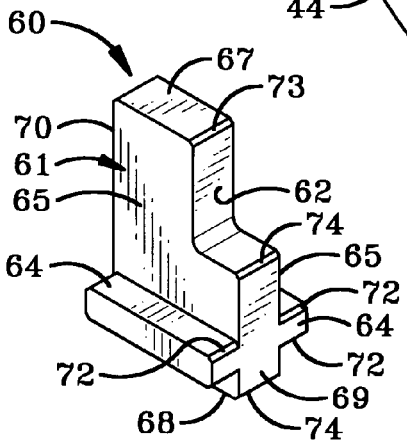
FIG. 4 is a perspective view of the alignment key.
Figure 6:
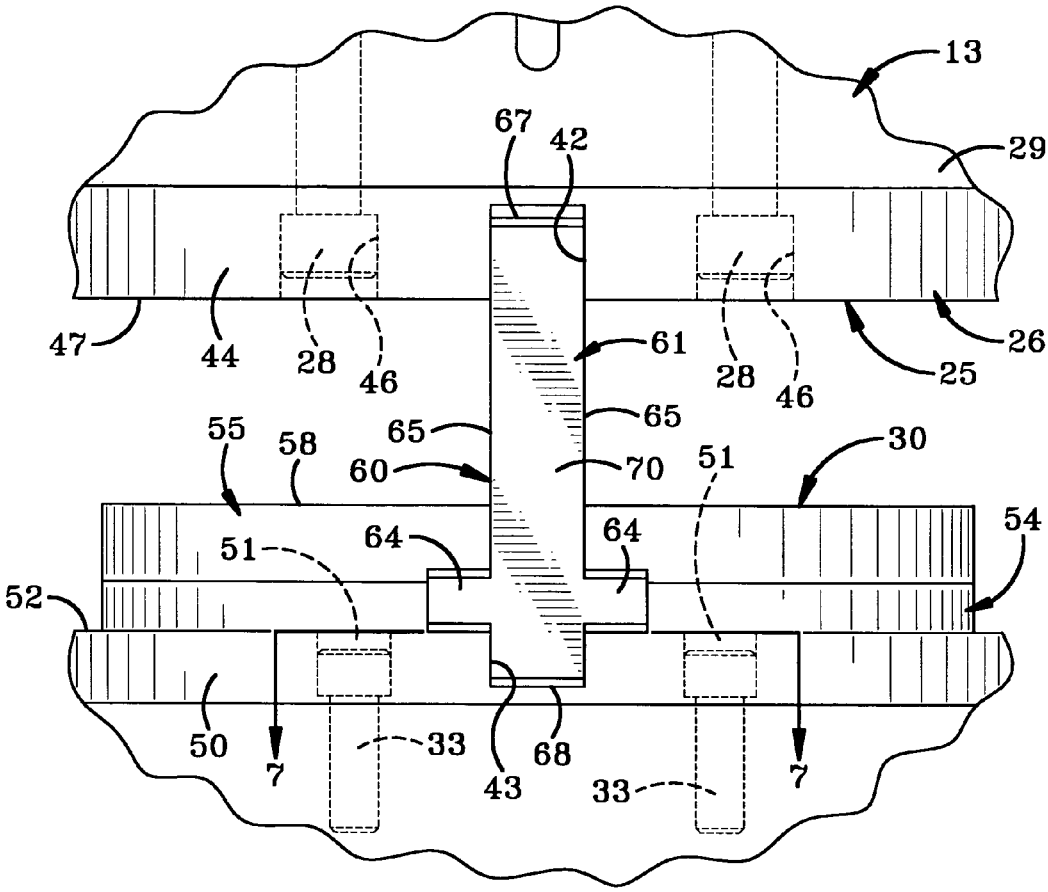
FIG. 6 is a fragmentary side elevational view of FIG. 5 showing the alignment key engaged with the cut ring and blank and draw die.
Figure 7:
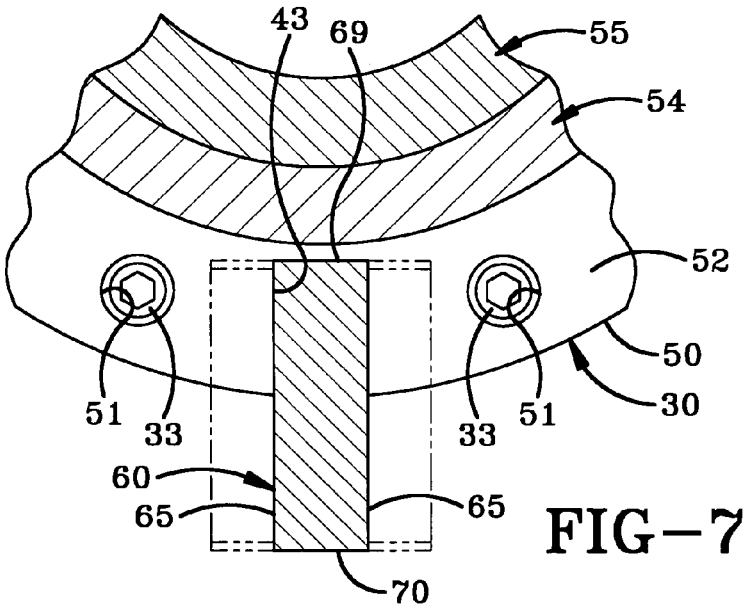
FIG. 7 is a fragmentary sectional view taken on line 7—7, FIG. 6.

As shown in FIG. 6, stabilizing legs 64 facilitate the placement and alignment of key 60 in opening 43. Cutout 62 is required in key 60 due to the greater outer diameter of cut ring 25 than that of blank and draw die 30, as shown in FIG. 5. However, it can have a different configuration than right angled, as shown in FIG. 4.

The same procedure discussed above will be used should an existing cut ring and blank and draw die for forming circular cut blanks be removed and retrofitted with the non-round forming members 25 and 30 since the outer circumferences and bolt locations would be the same, with only the diameters D1–D4 being precision formed in the newly installed members.

Thus, it is easily seen that an existing press can be changed from producing round disc-shaped blanks to non-round disc-shaped blanks very easily by removing the existing annular members and replacing the same with members 25 and 30 discussed above. Likewise, should a malfunction or misalignment occur during manufacture of non-round disc-shaped blanks, members 25 and 30 can easily be readjusted at the press site by merely loosening the bolts on one or both of the members and inserting key 60 in openings 42 and 43, followed by the subsequent tightening of the previously loosened bolts. This replaces the heretofore complicated procedures for aligning the non-round blank producing members, similar to members 25 and 30, which now can be accomplished easily at the press site in a matter of minutes.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method of aligning opposed telescopically engageable first and second annular components mounted in a press for making non-round disc-shaped blanks for subsequent forming into container bodies including the steps of:

providing the first annular component with a precision formed opening at a precise location;

providing the second component with a precision formed opening at a precise location;

forming said first and second openings in their respective components whereby major and axes of said components are in accurate alignment with each other when said openings are in alignment with each other;

mounting said first and second components in a spaced relationship from each other in the press whereby said notches are in general alignment with each other;

inserting an alignment key between the spaced components and into the spaced openings;

rotatably adjusting one of said components until the alignment key properly seats in the spaced openings which accurately align the major and minor axes of the spaced components with respect to each other; and securing the components in their accurately aligned positions in the press.

2. The method defined in claim 1 wherein the precision openings are notches formed in the periphery of the first and second annular components.

3. The method defined in claim 2 wherein the notches are formed with a 5 rectangular configuration.

4. The method defined in claim 2 wherein each of the notches is formed with an open end; and in which the key is slidably inserted through said open ends into the notches.

5. The method defined in claim 2 wherein the alignment key is formed with a parallelepiped shaped body with a pair of outwardly extending stabilizing legs.

6. The method defined in claim 1 wherein the first annular component is a cut ring and the second annular component is a blank and draw die; in which the cut ring is formed with a non-round central opening defined by the major and minor axes; and in which the blank and draw die has an outer non-round disc forming surfaces defined by the major and minor axes.

7. The method defined in claim 6 wherein the cut ring has a greater outer diameter than the blank and draw die; and in which the alignment key is formed with a right angled notch in a corner thereof to adjust for the difference in diameters.

8. The method defined in claim 1 wherein the step of mounting the annular components in the press includes securely mounting one of said components and loosely mounting the other of said components prior to inserting the alignment key into the spaced openings.

9. The method defined in claim 8 wherein the first component is a cut ring and the second component is a blank and draw die, in which the cut ring is spaced vertically above the blank and draw die, and in which the blank and draw die is the component which is securely mounted after inserting the alignment key into the spaced openings.

10. A method of retrofitting a container body forming press from producing round disc-shaped blanks to producing non-round disc-shaped blanks comprising the steps of:

removing a cut ring and a blank and draw die having telescopically engageable mating surfaces for cutting round disc-shaped blanks from sheet material;

providing a cut ring with a non-round central opening defined by major and minor axes with a precision opening formed at a precise location; providing the blank and draw die with a non-round outer cut edge defined by major and minor axes with a precision opening formed at a precise location;

forming said first and second openings whereby major and minor axes of said cut ring and blank and draw die are in accurate alignment with each other when said openings are in accurate alignment with each other;

mounting said cut ring and blank and draw die in a spaced relationship from each other in the press whereby said precision openings are in general alignment with each other; inserting an alignment key into the spaced openings;

rotatably adjusting one of said cut ring and blank and draw die until the alignment key properly seats in the spaced openings which accurately aligns the major and minor axes of the spaced cut ring and blank and draw die with respect to each other; and securing the cut ring and blank and draw die in their accurately aligned positions in the press while the key is in the spaced opening and extending between the cut ring and blank and draw die.

11. The method defined in claim 10 wherein the precision openings are rectangularly-shaped notches formed in peripheries of the cut ring and blank and draw die, respectively; and in which the alignment key is slidably inserted into said notches.

12. The method defined in claim 11 wherein the alignment key has parallelopiped-shaped body with a pair of stabilizing legs extending perpendicularly outwardly from opposite sides of said body.

13. The method defined in claim 12 wherein the alignment key body has a right angled notch formed in one corner thereof to provide clearance from the cut ring.

14. The method defined in claim 10 wherein the cut ring is spaced vertically above the blank and draw die in the press.

15. A key for aligning a cut ring and a blank and draw die when mounted in a press for making non-round blanks for subsequent forming into container components comprising:

a main body having a first end complementary to the cross sectional shape of a notch formed in the periphery of the cut ring and a second end complementary to the cross sectional shape of a notch formed in the periphery of the blank and draw die; and stabilizing legs extending outwardly from the main body adapted to engage one of the cut ring and blank and draw die when the first and second body ends are engaged in the notches formed therein.

16. The key as defined in claim 15 wherein the body has a parallelopiped configuration with a right angle cutout being formed in a corner thereof.

17. The key as defined in claim 15 wherein portions of the main body have tapered edges to facilitate engagement of the first and second ends in the notches.

18. The key as defined in claim 15 wherein the stabilizing legs each have an elongated rectangular configuration terminating in a tapered edge.

19. The key defined in claim 15 wherein the stabilizing legs are spaced above an adjacent end surface of the main body and extend throughout the length of the side surfaces.

20. The key defined in claim 15 wherein the key is formed of a one-piece member formed of tool steel.

* * * * *

UNITED STATES PATENT AND TRADEMARK OFFICE

CERTIFICATE OF CORRECTION

PATENT NO. : 7,007,535 B2
APPLICATION NO. : 10/686352
DATED : March 7, 2006
INVENTOR(S) : James A. McClung It is certified that error appears in the above-identified patent and that said Letters Patent is hereby corrected as shown below:

Col. 5, line 9, "0.00 1" should read --0.001--.

Signed and Sealed this

Eighteenth Day of July, 2006

JON W. DUDAS
*Director of the United States Patent and Trademark Office*